US008554552B2

(12) United States Patent
Jeong et al.

(10) Patent No.: US 8,554,552 B2
(45) Date of Patent: Oct. 8, 2013

(54) APPARATUS AND METHOD FOR RESTORING VOICE

(75) Inventors: Jae-hoon Jeong, Yongin-si (KR); Kwang-cheol Oh, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 780 days.

(21) Appl. No.: 12/609,047

(22) Filed: Oct. 30, 2009

(65) Prior Publication Data

US 2010/0114570 A1 May 6, 2010

(30) Foreign Application Priority Data

Oct. 31, 2008 (KR) ..... 10-2008-0107774

(51) Int. Cl.
*G10L 21/02* (2013.01)

(52) U.S. Cl.
USPC ..... 704/226; 704/233

(58) Field of Classification Search
USPC ..... 704/226, 233, 266
See application file for complete search history.

(56) References Cited

U.S. PATENT DOCUMENTS

| | | | | |
|---|---|---|---|---|
| 3,723,877 | A * | 3/1973 | Miller | 375/254 |
| 5,133,013 | A * | 7/1992 | Munday | 704/226 |
| 5,701,390 | A | 12/1997 | Griffin et al. | |
| 6,047,253 | A | 4/2000 | Nishiguchi et al. | |
| 6,272,460 | B1 * | 8/2001 | Wu et al. | 704/226 |
| 6,694,291 | B2 * | 2/2004 | Mauro et al. | 704/205 |
| 7,117,149 | B1 * | 10/2006 | Zakarauskas | 704/233 |
| 7,742,914 | B2 * | 6/2010 | Kosek et al. | 704/205 |
| 7,885,420 | B2 * | 2/2011 | Hetherington et al. | 381/94.2 |
| 2003/0112265 | A1 * | 6/2003 | Zhang | 345/723 |
| 2003/0204543 | A1 | 10/2003 | Yoon et al. | |
| 2005/0141731 | A1 | 6/2005 | Hamalainen | |
| 2007/0027681 | A1 | 2/2007 | Kim | |
| 2007/0033031 | A1 * | 2/2007 | Zakarauskas | 704/233 |
| 2007/0076898 | A1 | 4/2007 | Sarroukh et al. | |
| 2007/0273585 | A1 | 11/2007 | Sarroukh et al. | |
| 2007/0288232 | A1 | 12/2007 | Kim | |

FOREIGN PATENT DOCUMENTS

| | | | |
|---|---|---|---|
| JP | 10-097296 | | 4/1998 |
| JP | 2002-162982 | | 6/2002 |
| KR | 19960032298 | B | 9/1996 |
| KR | 19960705303 | C | 10/1996 |
| KR | 1019980024790 | A | 7/1998 |
| KR | 1020010082280 | | 8/2001 |
| KR | 1020030085354 | | 11/2003 |
| KR | 1020060113714 | | 11/2006 |
| KR | 1020070004893 | | 1/2007 |
| KR | 1020070015811 | | 2/2007 |
| KR | 1020070099372 | | 10/2007 |
| KR | 1020080000478 | | 1/2008 |
| KR | 1020080006509 | | 1/2008 |
| KR | 1020080025212 | | 3/2008 |
| WO | WO 95/08170 | | 3/1995 |
| WO | WO 00/26897 | | 5/2000 |

* cited by examiner

*Primary Examiner* — Abul Azad
(74) *Attorney, Agent, or Firm* — NSIP Law

(57) ABSTRACT

An apparatus and a method for restoring voice are provided. The apparatus reduces noise included in a voice signal input to a microphone and outputs a voice signal having reduced noise, detects harmonic frequencies from the voice signal having reduced noise, and restores the voice signal having reduced noise approximate to its original state before being input to the microphone according to detected harmonic frequencies of the voice signal having reduced noise.

10 Claims, 5 Drawing Sheets

APPARATUS AND METHOD FOR RESTORING VOICE

CROSS-REFERENCE TO RELATED APPLICATION

This application claims the benefit under 35 U.S.C. §119 (a) of a Korean Patent Application No. 10-2008-107774, filed Oct. 31, 2008 in the Korean Intellectual Property Office, the disclosure of which is incorporated herein in its entirety by reference for all purposes.

BACKGROUND

1. Field

The following description relates to an apparatus and method for restoring voice, and more particularly, to an apparatus and method for restoring voice distorted by noise reduction.

2. Description of the Related Art

Computers or portable terminals improve a voice signal by reducing noise from a voice input through a microphone.

However, when noise included in a voice signal is reduced, a part of the voice signal is also reduced. Thus, a voice signal having less noise than the original voice is distorted and output. Accordingly, a user may not correctly recognize the distorted voice signal.

SUMMARY

In one general aspect, an apparatus for restoring an input voice signal by strengthening its harmonics includes a noise reducer for reducing noise included in the input voice signal and outputting a voice signal having reduced noise, a harmonic detector for detecting the harmonics of the voice signal having reduced noise, and a harmonic restorer for restoring the voice signal having reduced noise by strengthening it in at least a part of the harmonics detected by the harmonic detector according to the input voice signal.

The harmonic detector may detect the harmonics of the voice signal having reduced noise according to peaks and valleys of the voice signal having reduced noise.

The harmonic detector may detect the harmonic frequencies of the voice signal having reduced noise according to, as a fundamental frequency of the voice signal having reduced noise, a frequency of a peak corresponding to the largest of power sums calculated according to peak frequencies of the voice signal having reduced noise.

The harmonic detector may calculate a harmonic frequency of a k-th peak according to the average of harmonic frequencies of first to (k−2)th peaks of the voice signal having reduced noise and the (k−1)th harmonic frequency.

The harmonic restorer may output the input voice signal with a strongest compared to the voice signal having reduced noise at a harmonic peak of the voice signal having reduced noise, and output the voice signal having reduced noise with a strongest signal compared to the input voice signal at a valley between harmonics of the voice signal having reduced noise.

In another general exemplary aspect, a method of restoring voice includes reducing noise included in an input voice signal to generate a voice signal having reduced noise, detecting harmonics of the voice signal having reduced noise, and restoring the voice signal having reduced noise by strengthening the voice signal having reduced noise in at least a part of the detected harmonics using the input voice signal.

The detecting of the harmonics of the voice signal having reduced noise may include detecting the harmonics of the voice signal having reduced noise according to peaks and valleys of the voice signal having reduced noise.

The detecting of the harmonics of the voice signal having reduced noise may include detecting the harmonics of the voice signal having reduced noise according to, as a fundamental frequency of the voice signal having reduced noise, a frequency of a peak corresponding to the largest of power sums calculated according to peak frequencies of the voice signal having reduced noise.

The detecting of the harmonics of the voice signal having reduced noise may include calculating a harmonic frequency of a k-th peak according to an average of harmonic frequencies of first to (k−1)th peaks of the voice signal having reduced noise and the (k−1)th harmonic frequency.

The restoring of the voice signal having reduced noise by strengthening the voice signal having reduced noise in at least a part of the detected harmonics using the input voice signal may include outputting the input voice signal with the strongest signal compared to the voice signal having reduced noise at a harmonic peak of the voice signal having reduced noise, and outputting the voice signal having reduced noise with the strongest signal compared to the input voice signal at a harmonic valley of the voice signal having reduced noise.

In still another general exemplary aspect, an apparatus for restoring voice is configured to restore a voice signal having reduced noise by strengthening its harmonics using an input voice signal and the voice signal having reduced noise.

Other features and aspects will be apparent from the following description, the drawings, and the claims.

Figure 1:
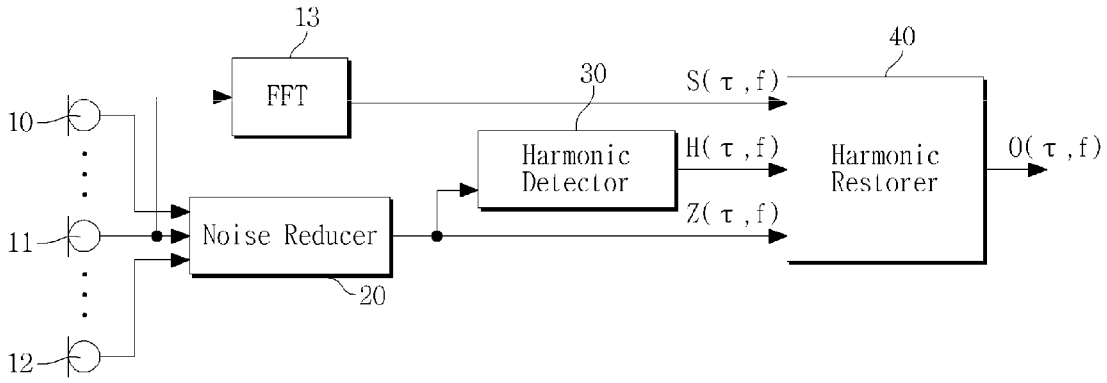
FIG. 1 is a diagram illustrating the structure of an exemplary apparatus for restoring voice.

Throughout the drawings and the detailed description, unless otherwise described, the same drawing reference numerals will be understood to refer to the same elements, features, and structures. The relative size and depiction of these elements may be exaggerated for clarity, illustration, and convenience.

DETAILED DESCRIPTION

The following detailed description is provided to assist the reader in gaining a comprehensive understanding of the methods, apparatuses and/or systems described herein. Accordingly, various changes, modifications, and equivalents of the systems, apparatuses and/or methods described herein will be suggested to those of ordinary skill in the art. Also, descriptions of well-known functions and constructions may be omitted for increased clarity and conciseness.

FIG. 1 is a diagram illustrating the structure of an exemplary apparatus for restoring voice.

As illustrated in FIG. 1, an apparatus 1 for restoring voice according to one example restores a voice signal having reduced noise as the original voice signal by strengthening its harmonics using the input voice signal and the voice signal having reduced noise. Harmonics generally have a high signal to noise ratio relative to the signal to noise ratio of valleys.

The apparatus 1 for restoring voice includes a noise reducer 20, a harmonic detector 30, and a harmonic restorer 40.

The noise reducer 20 reduces noise included in a voice signal input to microphones 10, 11 and 12. When the microphones 10, 11 and 12 are adjacent to a sound source, a difference between the voice signals at microphone inputs is not substantial, and thus voice can be input through one of the microphones 10, 11 and 12. However, when the distance between the microphones 10, 11 and 12 and the sound source increases, the difference between microphone inputs increases. Here, the microphone 10, 11 or 12 nearest to the sound source may be selected to input voice. The voice signal input from the microphones 10, 11 and 12 is fast-Fourier-transformed by a fast Fourier transformer (FFT) 13 and input to the harmonic detector 30.

The harmonic detector 30 detects harmonics of the voice signal having reduced noise. More specifically, the harmonic detector 30 detects harmonics of the voice signal having reduced noise according to peaks and valleys of the voice signal having reduced noise. This harmonic detection is described herein.

The harmonic restorer 40 restores the voice signal having reduced noise by strengthening it at parts of the harmonics detected by the harmonic detector 30 using the voice signal input to the microphones 10, 11 and 12. More specifically, the harmonic restorer 40 outputs the voice signal input to the microphones 10, 11 and 12 with the strongest signal compared to the voice signal having reduced noise at peaks of the detected harmonics, while outputting the voice signal having reduced noise, with the strongest signal, compared to the voice signal input to the microphones 10, 11 and 12 at valleys of the detected harmonics.

This relationship is expressed by Equation 1 below:

$$O(\tau, f) = \begin{cases} \omega \cdot S(\tau, f) + (1-\omega) \cdot Z(\tau, f), \text{ if } H(\tau, f) \text{ is peak} \\ (1-\omega) \cdot S(\tau, f) + \omega \cdot Z(\tau, f), \text{ if } H(\tau, f) \text{ is valley.} \end{cases} \quad \text{[Equation 1]}$$

In other words, at peaks of a detected harmonic H(τ,f), a voice signal S(τ,f) input to a microphone, with the strongest signal compared to a voice signal Z(τ,f) having reduced noise, is output as a restored voice signals O(τ,f). For example, when ω is 0.9, the restored voice signal O(τ,f) output at peaks of the detected harmonic H(τ,f) includes of 10% the voice signal Z(τ,f) having reduced noise and 90% the voice signal S(τ,f) input to a microphone.

On the other hand, at valleys of the detected harmonic H(τ,f), the voice signal Z(τ,f) having reduced noise, with the strongest signal compared to the voice signal S(τ,f) input to a microphone, is output as the restored voice signal O(τ,f). For example, when ω is 0.9, the restored voice signal O(τ,f) output at valleys of the detected harmonic H(τ,f) includes of 90% the voice signal Z(τ,f) having reduced noise and 10% the voice signal S(τ,f) input to a microphone.

Figure 6:
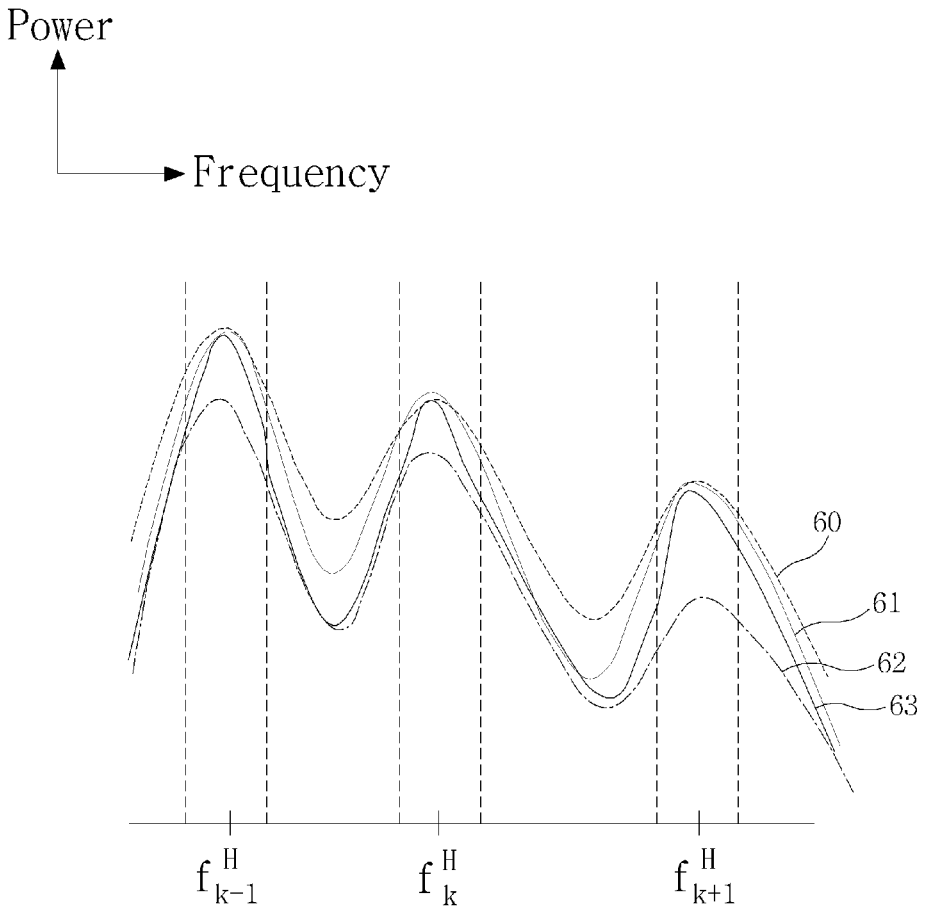
FIG. 6 is a graph illustrating the relationships between a voice signal input to a microphone, a voice signal having reduced noise and a restored voice signal.

Accordingly, a restored voice signal output from the apparatus 1 for restoring voice is substantially a voice signal input to the microphones 10, 11 and 12 at peaks of harmonics and substantially to a voice signal having reduced noise at valleys of the harmonics. FIG. 6 is a graph illustrating the relationships between a voice signal input to a microphone, a voice signal having reduced noise and a restored voice signal. As illustrated in FIG. 6, a restored voice signal 63 approximates a voice signal 60 input to the microphones 10, 11 and 12 at peaks of detected harmonics, and the restored voice signal 63 approximates a voice signal 62 having reduced noise at valleys of the detected harmonics. Thus, the restored voice signal 63 overall approximates a voice signal 61 not including noise.

Figure 2:
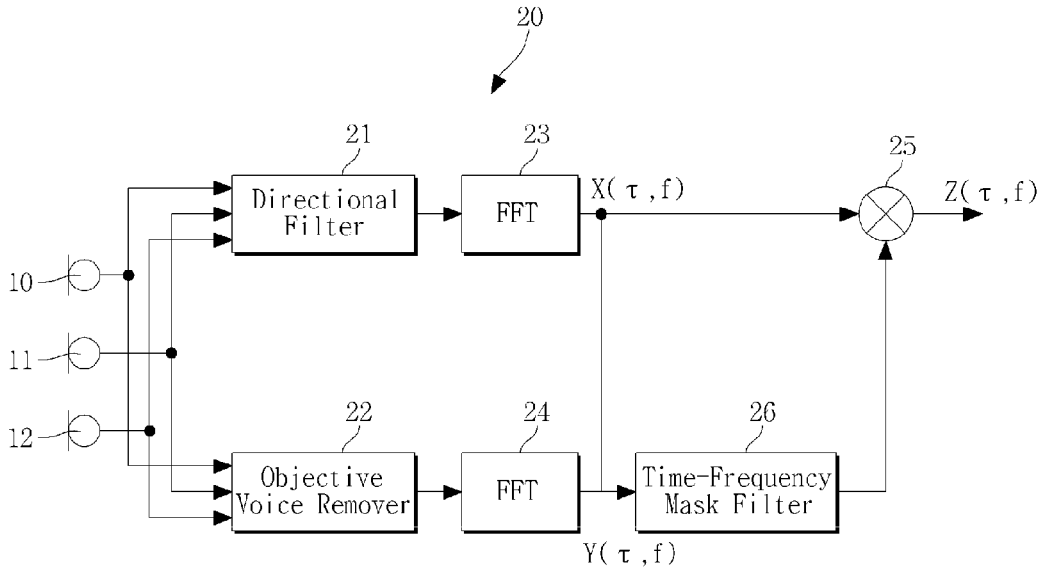
FIG. 2 is a diagram illustrating the structure of an exemplary noise reducer.

FIG. 2 is a diagram illustrating the structure of an exemplary noise reducer.

As illustrated in FIG. 2, the noise reducer 20 according to one example includes a directional filter 21, an target voice remover 22, a mixer 25, and a time-frequency mask filter 26.

The directional filter 21 outputs a voice signal input from a microphone within a certain directional range among the microphones 10, 11 and 12, and may remove voice signals input from the other microphones. Since the directional filter 21 outputs a voice signal input from a microphone within a certain directional range, the output voice signal may be predominantly voice compared to noise. The output voice signal of the directional filter 21 may accordingly be referred to as an output voice signal having superior voice, and is Fourier-transformed by an FFT 23 and input to the mixer 25 and the time-frequency mask filter 26.

The target voice remover 22 intercepts a voice signal input from a microphone within a certain directional range among the microphones 10, 11 and 12. Since the target voice remover 22 intercepts a voice signal input from a microphone within a certain directional range, it may output a voice signal having predominantly noise compared to voice. The output voice signal of the target voice remover 22 may accordingly be referred to as an output voice signal having superior noise is Fourier-transformed by an FFT 24 and input to the time-frequency mask filter 26.

The time-frequency mask filter 26 generates and outputs a mask filter, with respect to a frequency of the voice signal having superior voice and a frequency of the voice signal having superior noise, in a time-frequency domain according to the voice signal having superior voice and the voice signal having superior noise Fourier-transformed by the FFTs 23 and 24. Here, the generated mask filter may pass a signal at the frequency of the voice signal having superior voice, and prevent a signal from passing at the frequency of the voice signal having superior noise.

The mixer 25 mixes the voice signal having has superior voice output from the FFT 23 with the mask filter output from the time-frequency mask filter 26, thereby outputting voice signal Z(τ,f) having superior voice.

Figure 3:
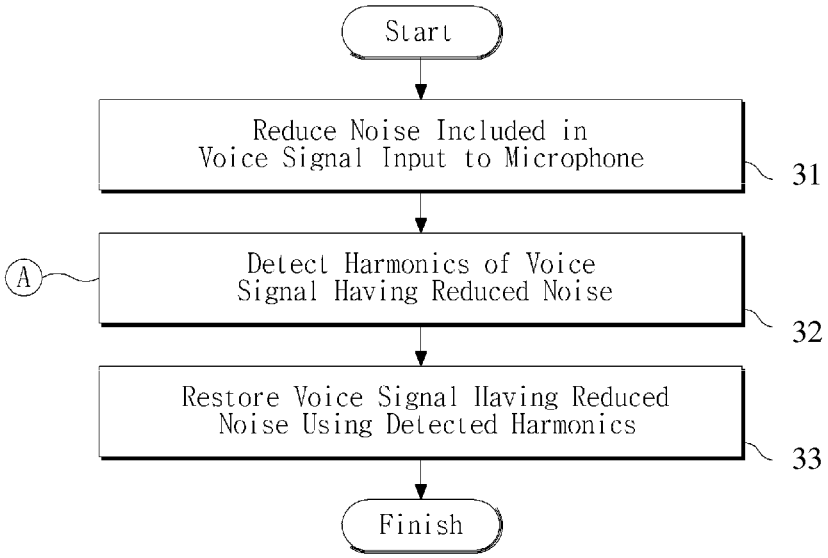
FIG. 3 is a flowchart illustrating an exemplary method of restoring voice.

FIG. 3 is a flowchart illustrating an exemplary method of restoring voice.

As illustrated in FIGS. 1 and 2, the apparatus for restoring voice reduces noise included in a voice signal input to the microphones 10, 11 and 12 (operation 31). When the microphones 10, 11 and 12 are adjacent to a sound source, a difference between the voice signals at microphone inputs is not substantial, and thus voice can be input through any one of the microphones 10, 11 and 12. However, when the distance between the microphones 10, 11 and 12 and the sound source increases, the difference between microphone inputs increases. Here, the microphone 10, 11 or 12 nearest to the sound source may be selected to input voice. The voice signal input from the microphones 10, 11 and 12 is Fourier-transformed by the FFT 13 and input to the harmonic detector 30.

The apparatus for restoring voice detects harmonics of the voice signal having reduced noise (operation 32). More specifically, the apparatus for restoring voice may detect harmonics of the voice signal having reduced noise according to peaks and valleys of the voice signal.

The apparatus for restoring voice restores the voice signal having reduced noise by strengthening it at parts of the detected harmonics using the input voice signal (operation 33). More specifically, the apparatus for restoring voice outputs the voice signal input to the microphones 10, 11 and 12 with the strongest signal compared to the voice signal having reduced noise at peaks of the detected harmonics, while outputting the voice signal having reduced noise, with the strongest signal, compared to the voice signal input to the microphones 10, 11 and 12 at valleys of the detected harmonics. This relationship is expressed by Equation 1 above.

Figure 4:
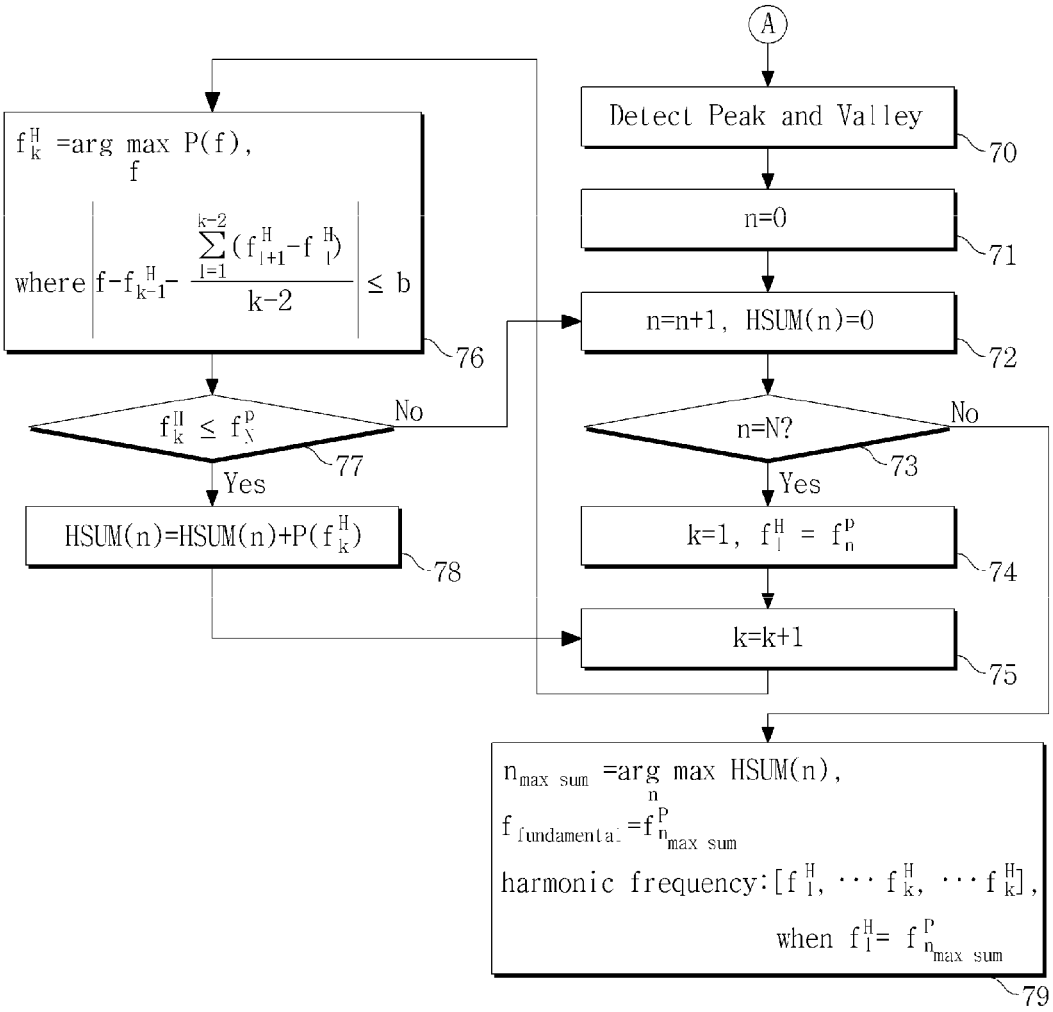
FIG. 4 is a flowchart illustrating an exemplary method of detecting harmonic frequencies of a voice signal.

FIG. 4 is a flowchart illustrating an exemplary method of detecting harmonic frequencies of a voice signal.

As illustrated in the drawing, the apparatus for restoring voice detects peaks and valleys of a voice signal (operation 70). Here, a peak of the voice signal is a point at which the slope of the signal waveform changes from positive to negative, and a valley is a point at which the slope of the signal waveform changes from negative to positive. Furthermore, in operation 70, the apparatus for restoring voice may detect peaks which have a value of a set threshold value or more, and remove peaks below the threshold value. The peaks below the threshold value may accordingly be referred to as local peaks.

The apparatus for restoring voice initializes a peak variable n indicating a sequence of the N detected peaks (operation 71). Accordingly, when the peak variable n is increased, a power sum HSUM(n) of harmonics of an n-th peak frequency is initialized, such that the n-th peak frequency is a fundamental frequency (operation 72).

The apparatus for restoring voice checks whether an n-th peak corresponds to an N-th peak (operation 73). If an n-th peak is not an N-th peak, the apparatus for restoring voice sets a harmonic variable k to 1 and sets a first harmonic frequency $f_1^H$ as an n-th peak frequency $f_n^P$, such that the n-th peak frequency is the fundamental frequency (operation 74). Accordingly, the apparatus for restoring voice increases the harmonic variable k (operation 75). As described above, the apparatus for restoring voice calculates harmonic frequencies, commencing with a second harmonic frequency.

If an n-th peak frequency is the fundamental frequency, the apparatus for restoring voice may calculate harmonic frequencies commencing with a second harmonic frequency according to the following Equation (operation 76):

$$f_k^H = \arg\max_f P(f), \text{ here} \left| f - f_{k-1}^H - \frac{\sum_{l=0}^{k-2}(f_{l+1}^H - f_l^H)}{k-2} \right| \le b. \quad \text{[Equation 2]}$$

Here, $$f_{k-1}^H$$

denotes the (k−1)th harmonic frequency, $$\frac{\sum_{l=0}^{k-2}(f_{l+1}^H - f_l^H)}{k-2}$$

denotes the average of differences between two successive harmonic frequencies among first to (k−1)th harmonic frequencies, $f_k^H$ denotes a k-th harmonic frequency, b denotes a frequency range set based upon the k-th harmonic frequency $f_k^H$, P(f) denotes power at a frequency f, and $$\arg\max_f P(f)$$

denotes a frequency of the largest power P(f) under the condition $$\left| f - f_{k-1}^H - \frac{\sum_{l=0}^{k-2}(f_{l+1}^H - f_l^H)}{k-2} \right| \le b.$$

Figure 5:
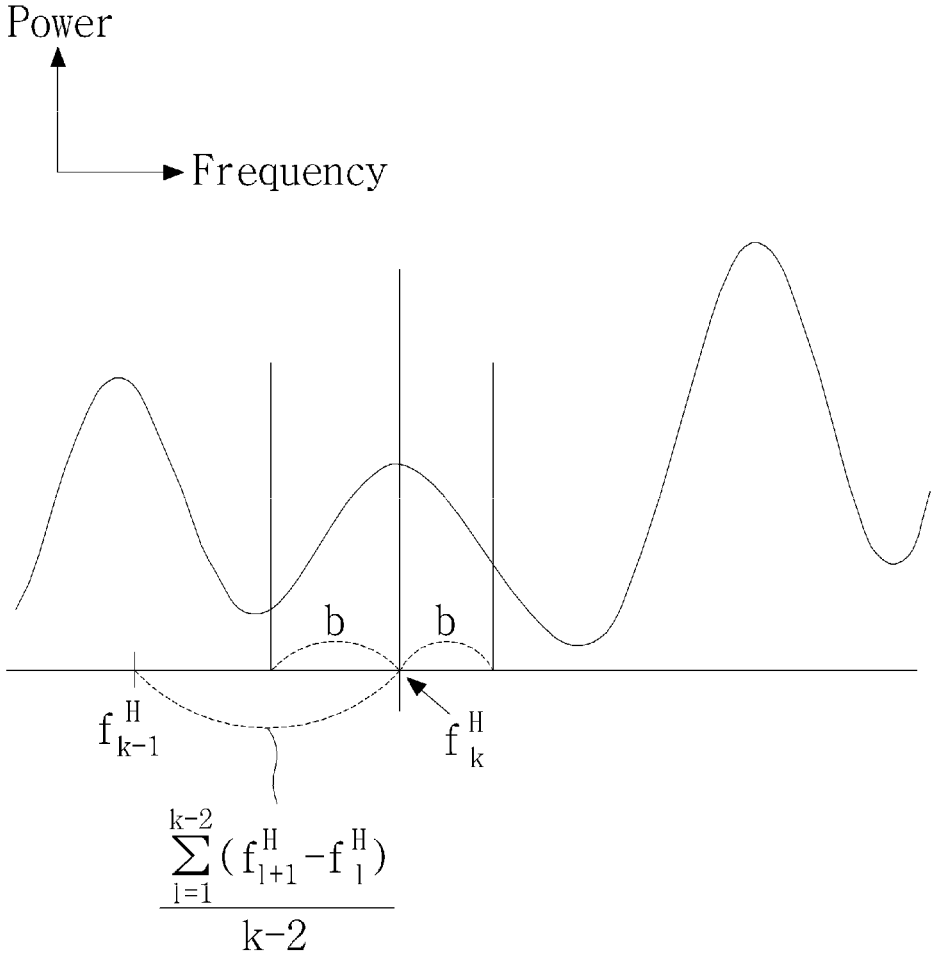
FIG. 5 is a graph illustrating the relationship between harmonic frequencies of a voice signal.

FIG. 5 is a graph illustrating the relationship between the average $$\frac{\sum_{l=0}^{k-2}(f_{l+1}^H - f_l^H)}{k-2}$$

differences between two successive harmonic frequencies among the first to (k−1)th harmonic frequencies, the k-th harmonic frequency $f_k^H$, and the frequency range b set based upon the (k−1)th harmonic frequency $f_{k-1}^H$ and the k-th harmonic frequency $f_k^H$. As illustrated in FIG. 5, according to a frequency corresponding to the average interval of two successive harmonic frequencies among the first to (k−1)th harmonic frequencies, the frequency range b set based upon the k-th harmonic frequency $f_k^H$ is set, and the k-th harmonic frequency $f_k^H$ is disposed within the set range b.

The apparatus for restoring voice checks whether or not the calculated harmonic frequency $f_k^H$ is a frequency $f_N^P$ of the N-th peak or less (operation 77). When the calculated harmonic frequency $f_k^H$ is the frequency $f_N^P$ of the N-th peak or less, the apparatus for restoring voice adds a power $P(f_k^H)$ of the k-th harmonic to the power sum HSUM(n) of the first to (k−1)th harmonics (operation 78). Subsequently, the apparatus for restoring voice increases the harmonic variable k (operation 75), and then repeats the process of calculating harmonic frequencies according to the increased harmonic variable k and calculating a harmonic power sum.

On the other hand, if the calculated harmonic frequency $f_k^H$ is determined to be greater than the frequency $f_N^P$ of the N-th peak (operation 77), the apparatus for restoring voice increases the peak variable n and initializes the power sum HSUM(n) of harmonics of an n-th peak frequency (operation 72), such that the n-th peak frequency is the fundamental frequency. Accordingly, harmonic frequencies of an n-th peak and a harmonic power sum may again be calculated.

Meanwhile, if it is determined that the n-th peak is the N-th detected peak (operation 73), the apparatus for restoring voice sets a peak frequency having the largest of peak-specific harmonic power sums of the voice signal as the fundamental frequency of the voice signal, and calculates harmonic frequencies of the set fundamental frequency (operation 79).

More specifically, the apparatus for restoring voice sets the argument n of the largest of peak-specific harmonic power sums of the voice signal, $$\arg\max_n HSUM(n),$$

as $n_{maxsum}$, and sets the corresponding peak frequency $f_{n_{maxsum}}^P$ as the fundamental frequency $f_{fundamental}$ of the voice signal.

Additionally, the apparatus for restoring voice calculates harmonic frequencies $[f_1^H, \ldots, f_k^H, \ldots, f_K^H]$ of the set fundamental frequency. Here, the first harmonic frequency $f_1^H$ is equal to the frequency $f_{n_{maxsum}}^P$ of the peak having the largest of the peak-specific harmonic power sums of the voice signal.

As apparent from the above description, a noise-reduced voice signal may be substantially restored as an original voice signal. The methods described above may be recorded, stored, or fixed in one or more computer-readable storage media that includes program instructions to be implemented by a computer to cause a processor to execute or perform the program instructions. The media may also include, alone or in combination with the program instructions, data files, data structures, and the like. Examples of computer-readable media include magnetic media, such as hard disks, floppy disks, and magnetic tape; optical media such as CD ROM disks and DVDs; magneto-optical media, such as optical disks; and hardware devices that are specially configured to store and perform program instructions, such as read-only memory (ROM), random access memory (RAM), flash memory, and the like. Examples of program instructions include machine code, such as produced by a compiler, and files containing higher level code that may be executed by the computer using an interpreter. The described hardware devices may be configured to act as one or more software modules in order to perform the operations and methods described above, or vice versa.

A number of exemplary embodiments have been described above. Nevertheless, it will be understood that various modifications may be made. For example, suitable results may be achieved if the described techniques are performed in a different order and/or if components in a described system, architecture, device, or circuit are combined in a different manner and/or replaced or supplemented by other components or their equivalents. Accordingly, other implementations are within the scope of the following claims.

What is claimed is:

1. An apparatus for restoring an input voice signal, comprising:

a noise reducer configured to reduce noise included in the input voice signal and outputting a voice signal having reduced noise;

a harmonic detector configured to detect harmonics of the voice signal having reduced noise; and a harmonic restorer configured to restore the voice signal having reduced noise by strengthening the voice signal having reduced noise in at least a part of the harmonics detected by the harmonic detector according to the input voice signal.

2. The apparatus of claim 1, wherein the harmonic detector detects the harmonics of the voice signal having reduced noise according to peaks and valleys of the voice signal having reduced noise.

3. The apparatus of claim 2, wherein the harmonic detector detects the harmonic frequencies of the voice signal having reduced noise according to, as a fundamental frequency of the voice signal having reduced noise, a frequency of a peak corresponding to the largest of power sums calculated according to peak frequencies of the voice signal having reduced noise.

4. The apparatus of claim 3, wherein the harmonic detector calculates a harmonic frequency of a k-th peak according to the average of harmonic frequencies of first to (k−1)th peaks of the voice signal having reduced noise and the (k−1)th harmonic frequency, wherein k is a predetermined harmonic variable.

5. The apparatus of claim 1, wherein the harmonic restorer:

outputs the input voice signal with a strongest signal compared to the voice signal having reduced noise at a harmonic peak of the voice signal having reduced noise; and outputs the voice signal having reduced noise with a strongest signal compared to the input voice signal at a harmonic valley of the voice signal having reduced noise.

6. A method of restoring voice, comprising:

reducing noise included in an input voice signal to generate a voice signal having reduced noise;

detecting harmonics of the voice signal having reduced noise; and restoring the voice signal having reduced noise by strengthening the voice signal having reduced noise in at least a part of the detected harmonics using the input voice signal.

7. The method of claim 6, wherein the detecting of the harmonics of the voice signal having reduced noise comprises detecting the harmonics of the voice signal having reduced noise according to peaks and valleys of the voice signal having reduced noise.

8. The method of claim 7, wherein the detecting of the harmonics of the voice signal having reduced noise comprises detecting the harmonics of the voice signal having reduced noise according to, as a fundamental frequency of the voice signal having reduced noise, a frequency of a peak corresponding to the largest of power sums calculated according to peak frequencies of the voice signal having reduced noise.

9. The method of claim 8, wherein the detecting of the harmonics of the voice signal having reduced noise comprises calculating a harmonic frequency of a k-th peak according to an average of harmonic frequencies of first to (k−1)th peaks of the voice signal having reduced noise and the (k−1)th harmonic frequency, wherein k is a predetermined harmonic variable.

10. The method of claim 6, wherein the restoring of the voice signal having reduced noise by strengthening the voice signal having reduced noise in at least a part of the detected harmonics using the input voice signal comprises:

outputting the input voice signal with the strongest signal compared to the voice signal having reduced noise at a harmonic peak of the voice signal having reduced noise; and outputting the voice signal having reduced noise with the strongest signal compared to the input voice signal at a harmonic valley of the voice signal having reduced noise.

* * * * *